US012305391B2

(12) United States Patent
Yasue

(10) Patent No.: US 12,305,391 B2
(45) Date of Patent: May 20, 2025

(54) BUILDING FACE MATERIAL WITH PRINTED INDICATIONS AND METHOD FOR MANUFACTURING THE SAME

(71) Applicant: YOSHINO GYPSUM CO., LTD., Tokyo (JP)

(72) Inventor: Kenzo Yasue, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 508 days.

(21) Appl. No.: 17/312,508

(22) PCT Filed: Jul. 26, 2019

(86) PCT No.: PCT/JP2019/029462
§ 371 (c)(1),
(2) Date: Jun. 10, 2021

(87) PCT Pub. No.: WO2020/129294
PCT Pub. Date: Jun. 25, 2020

(65) Prior Publication Data

US 2022/0056691 A1 Feb. 24, 2022

(30) Foreign Application Priority Data

Dec. 21, 2018 (JP) ..... 2018-239480

(51) Int. Cl.
*E04C 2/30* (2006.01)

(52) U.S. Cl.
CPC ..... *E04C 2/30* (2013.01)

(58) Field of Classification Search
CPC ..... B28B 19/0092
See application file for complete search history.

(56) References Cited

U.S. PATENT DOCUMENTS 4,858,402 A 8/1989 Putz
4,870,788 A * 10/1989 Hassan ..... E04C 2/526 52/105

(Continued)

FOREIGN PATENT DOCUMENTS

GB 2463490 3/2010
JP S53-015523 5/1978

(Continued)

OTHER PUBLICATIONS

Office Action mailed on Feb. 14, 2023 with respect to the corresponding Chinese patent application No. 201980083003.7.

(Continued)

*Primary Examiner* — Ian A Rummel
(74) *Attorney, Agent, or Firm* — IPUSA, PLLC

(57) ABSTRACT

A building face material with printed indications is provided, where, even when any part of the building face material is cut in a cutting process in a manufacturing process, each first printed indication is marked at an allowable distance from an end side of the building face material that is rectangular in a plan view, and printed indications are preliminarily marked at predetermined intervals, in a given column.

The building face material 10 with printed indications includes printed indication strings each including one string group that is repeated in cycles, the string group being formed, in a plan view, on a rectangular flat face of the building face material, and the strip group consisting of multiple printed indications that are arranged, at regular first intervals, in a predetermined order along at least one straight line driven to a first side 11 or a second side 12 of a rectangle.

9 Claims, 6 Drawing Sheets

(56) References Cited

U.S. PATENT DOCUMENTS

| | | | | |
|---|---|---|---|---|
| 4,927,696 | A * | 5/1990 | Berg | G01B 3/004 428/195.1 |
| 5,950,319 | A * | 9/1999 | Harris | E04F 21/04 33/494 |
| 6,012,255 | A * | 1/2000 | Smid | E04C 2/043 52/745.19 |
| 8,382,923 | B2 | 2/2013 | Okazaki et al. | |
| 2004/0035062 | A1* | 2/2004 | Martin | E04C 2/043 52/105 |
| 2004/0182272 | A1 | 9/2004 | Fox, Jr. et al. | |
| 2010/0122501 | A1* | 5/2010 | Thomas | E04C 2/043 52/506.01 |

FOREIGN PATENT DOCUMENTS

| | | |
|---|---|---|
| JP | S63-051012 U | 4/1988 |
| JP | H05-066138 U | 8/1993 |
| JP | H06-229061 | 8/1994 |
| JP | H07-062787 | 3/1995 |
| JP | H11-131684 | 5/1999 |
| JP | 3099013 U | 3/2004 |
| JP | 5412020 | 2/2014 |
| KR | 20-1995-0027696 | 10/1995 |
| WO | 2017/124703 | 7/2017 |

OTHER PUBLICATIONS

Office Action mailed on Feb. 20, 2023 with respect to the corresponding European patent application No. 19897555.9.
Office Action mailed on Aug. 29, 2023 with respect to the corresponding Korean patent application No. 10-2021-7018409.
Russian Office Action for 2021117352 mailed on Dec. 21, 2021.
Extended European Search Report for 19897555.9 mailed on Dec. 22, 2021.
International Search Report for PCT/JP2019/029462 mailed on Oct. 8, 2019.
Written Opinion of the International Searching Authority for PCT/JP2019/029462 mailed on Oct. 8, 2019.
Written Opinion of IPEA for PCT/JP2019/029462 mailed on Apr. 14, 2020.
Chapter II Report for PCT/JP2019/029462 mailed on Jul. 21, 2020.

* cited by examiner 25 mm FOR SPACING × 6 CHARACTERS = 150 mm FOR SPACING "_ 1 2 3 4 5"

25 mm FOR SPACING × 8 CHARACTERS = 200 mm FOR SPACING "_ 1 2 3 4 5 6 7"

25 mm FOR SPACING × 6 CHARACTERS = 150 mm FOR SPACING "□ ■ − ☆ ★ +"

33 mm FOR SPACING × 6 CHARACTERS = 200 mm FOR SPACING "□ ■ − ☆ ★ +"

25 mm FOR SPACING × 4 CHARACTERS = 100 mm FOR SPACING "_よしの" "_ボード"

25 mm FOR SPACING × 6 CHARACTERS = 150 mm FOR SPACING "_Ｂｏａｒｄ"

25 mm FOR SPACING × 8 CHARACTERS = 200 mm FOR SPACING "_せっこうボード"

BUILDING FACE MATERIAL WITH PRINTED INDICATIONS AND METHOD FOR MANUFACTURING THE SAME

TECHNICAL FIELD

The present disclosure relates to a building face material with printed indications and a method for manufacturing the building face material.

BACKGROUND ART

Various face materials such as gypsum boards or plywood are used as building face materials that form floors, walls, ceilings, and the like of buildings. Such building face materials are secured to pillars or studs by fastening them with screws, nails, or the like. For example, as a structure with fire-resistant performance that complies with a quasi-fire resistant structure as specified by the Building Standard Act, a structure that conforms to the standards specified by the Japan Housing Finance Agency is adopted. Features of a house with the quasi-fire resistant structure according to the ministerial ordinance include prevention of fire spreading from the outside, fire-retarding of each room, delay in fire spread. According to the standards for the quasi-fire resistant structure (wooden framework construction method or frame wall construction method), as specified by the ministerial ordinance, for example, for fastening of a gypsum board to studs, specific spacing between nails or the like that are driven to each of a peripheral portion and an intermediate portion of the gypsum board is defined. In light of the point described above, when marks representing positions where nails are to be driven are printed in advance on a given building face material, a worker at a site can accurately and efficiently fasten the building face material to studs or the like that are arranged at predetermined intervals, without depending on a skill level of the worker.

Conventionally, when marks are to be printed on building face materials, a method of removing given building face materials, one by one, from building face materials that are manufactured to have a predetermined size and that are piled by a lifter or the like, and subsequently, printing the marks by one or more ink jet printers, spray, or the like, is used. Such marks are printed on a given building face material that is manufactured to have the predetermined size. In such a case, each first mark is printed on the building face material that is rectangular in a plan view, at an allowable distance (typically, between about 10 mm and about 20 mm) from a given end side of the building face material, for example, and subsequently, marks can be printed along a straight line parallel to a long side of the building face material, at predetermined intervals. Note that the marks include cross shapes, dots, and grid lines in vertical and horizontal directions. Grid points are given as driving positions of nails or the like. Further, in the case of the grid lines, a first line at an allowable distance from a given end side can be also printed parallel to the end side.

For a structure of the grid lines described above, a graph gypsum board printed in a similar pattern to grid paper is proposed (see, for example, Patent document 1). Also, a board material with equally spaced lines as a guide is proposed, where with respect to each of a long side and a short side of the board material, the lines are placed by equal division of the board material in a predetermined number. The lines are visually perpendicular to each other, with respect to the long side or the short side of the board material with respect to a reference (see, for example, Patent document 2).

CITATION LIST

Patent Document

Patent document 1: Japanese Unexamined Utility Model Application Publication No. S63-51012

Patent document 2: Japanese Unexamined Utility Model Application Publication No. H5-66138

SUMMARY

However, when the method, as described above, is used to remove given building face materials, one by one, from piled building face materials, print marks on a removed building face material along a given straight line parallel to the long side of the removed building face material, return the building face material on which the marks are printed to the piled building face materials, and subsequently remove another building face material from the piled face materials to print marks in the same manner, significant time and labor may be required. Therefore, there is demand for improvements to be made.

In this regard, there exists a manufacturing method in which, at an upstream location of a production line for building face materials, marks are preliminarily printed at predetermined intervals. According to the manufacturing method, there is reduced burden in the task of removing given building face materials, one by one, from building face materials that are manufactured and piled, to print marks on a removed building face material, and subsequently returning the building face material on which the marks are printed to the piled building face materials.

Hereafter, a gypsum board is taken up as a building face material, and a flow of the method of manufacturing the gypsum board will be outlined. Further, an upstream location of a production line will be described. In the manufacture of the gypsum board, first, gypsum slurry is deposited on the front of a back paper (board base paper) that is continuously conveyed. Then, the back paper (board base paper) is folded along curved lines that are formed proximal to side edges of the back paper so as to wrap the gypsum slurry, while a front paper (board base paper) that is conveyed at the same speed as the back paper is laminated on a layer of the gypsum slurry. Then, the laminate of the back paper, the gypsum slurry, and the front paper is conveyed to a molding machine that determines a thickness and width of a given gypsum board, thereby forming a molding. In a process in which the molding is conveyed through a belt conveyor or the like, the molding is hardened by a hydration reaction of calcined gypsum in the gypsum slurry, and the hardened molding is roughly cut by a rough cutting machine (rotary cutter) or the like to thereby form a roughly cut body. The roughly cut body is conveyed to a dry machine (dryer) and is forcibly dried by the dry machine. Then, the dried cut body is cut to a product size by a cutting machine (sizer) or the like to thereby manufacture gypsum boards. The manufactured gypsum boards are piled up by a lifter or the like, as described above, and the piled gypsum boards are stored.

For example, the upstream location of the production line described above refers to a stage or the like at which the back paper or front paper is continuously conveyed, before forming a molding. The upstream location corresponds to a stage prior to least one rough cutting process. For example, one or more ink jet printers or the like are each provided at a predetermined location of a path of the back paper or the front paper that is continuously conveyed, and further, each of the ink jet printers to be switched on, based on a conveyance speed of the back paper or the like and a predetermined time interval, is used to enable marks to be printed at predetermined intervals. A molding is formed using at least one paper among the back paper and front paper on which marks are printed at a stage prior to the rough cutting process. Thus, the gypsum board printed with the marks that are at predetermined intervals on the front face, or both the front and back faces can be manufactured.

As described above, at the upstream location of the production line, the marks are printed on the front face of the building face material, at predetermined intervals. Thus, there is reduced burden in the task of removing given building face materials, one by one, from building face materials that are manufactured and piled, to print marks on a removed building face material, and subsequently the building face material on which the marks are printed is returned to the piled building face materials, can be reduced.

However, at the upstream location of the production line for building face materials, when a manufacturing method in which marks of one type are preliminarily printed at predetermined intervals is used, a distance between a given end side of a cut building face material and a given first mark is constantly shorter than a predetermined interval, except for a case where a location of the building face material that is cut to a length of a product exactly fits a location of the mark. In such a manner, nails or the like are driven at predetermined intervals, and further, a given nail or the like is driven at a given end side (a location is between about 10 mm and about 20 mm inward from the end side), as well as a given nail being driven at the first mark. In this case, the number of fixing portions such as nails that are driven may be increased by one, in comparison to a case where marks are printed at predetermined intervals, after a predetermined interval is first given from a given end side of the face material, or a given mark is printed at an allowable distance from a given end side of the face material.

The above-mentioned manner will be described with reference to FIG. 1. FIG. 1 is a front view of two building face materials that are arranged side by side, in a state of being fastened with nails, where the building face materials are manufactured by a manufacturing method in which at an upstream location of a production line, marks of one type are printed on each building face material, at predetermined intervals, and each building face material is cut to a length of a product. In FIG. 1, printed marks are represented by the circles, and driven nails are represented by the positive signs. For locations at which nails are each driven at a given printed mark, the positive signs in respective circles are represented. For locations of nails that are driven at locations where marks are not printed, only the positive signs are represented.

In an example of the building face material on the left side of the figure, a location of the building face material that is cut to a length of a product is preferable. Each first mark is printed at an allowable distance of 10 mm from the upper end (end side) of the building face material, and subsequently marks are printed at predetermined intervals each of which is 200 mm. Thus, given marks are each printed at an allowable distance of 10 mm from the lower end of the building face material. In this case, for each column, the number of marks is 10, and the number of nails is 10 because the nails are driven at all the marks.

In contrast, for the building face material on the right side of the figure, for example, each first mark is printed at a distance of 60 mm, which exceeds the allowable distance from the upper end (end side) of the building face material, and subsequently marks are printed at predetermined intervals each of which is 200 mm. In such a manner, a distance between each last nail and a given nail immediately before the last nail is 150 mm and consequently is not 200 mm, because the last nail needs to be driven at a distance of 10 mm from the end of the building face material. In this case, for each column, the number of marks is 9, while the number of nails is 11. Consequently, the number of marks is one greater than the number of nails used for the building face material on the left side of the figure.

As can be clearly seen from comparison of the building face materials on the left and right sides in FIG. 1, the distance from a given end side of each building face material to a given first mark is not necessarily the same. In such a manner, for example, as in the building face material on the right side in FIG. 1, for the intervals between given nails or the like, a given interval set proximal to a given end side of the building face material differs from intervals set in other area, and consequently fastening of the nails or the like is partially performed at a different interval. In other words, all the nails or the like are not regularly driven at predetermined intervals, and consequently it becomes difficult to manage under construction to check if nails or the like are driven at predetermined intervals. Additionally, a worker has a difficulty in the working because positions of the building face material to be fastened differ relatively.

Further, as described above, when the positions of the building face material to be fastened differ relatively, the building face material cannot be used in a case where the building face material is fastened to backing materials parallel to the short side of the building face material. Specifically, for example, when a given building face material in an upright position or in a lateral position is attached to baking materials, in a case such as when receiving materials, horizontal members, or the like are used, such a building face material cannot be used.

In contrast, when given building face materials are removed, one by one, from building face materials that are manufactured and piled, and marks are printed on a removed face material, given marks are each printed at a predetermined distance from a given end side of the building face material, or at an allowable distance from a given end side, and subsequently, marks can be printed at predetermined intervals. In such a method of printing marks, relative positions of the building face material to be fastened are the same, and thus variations in positions of each face material that is fastened do not occur.

As described above, when relative positions of the building face materials to be fastened are the same, the building face material can be also used in the case where the building face material is fastened to the backing materials parallel to the short side of the building face material.

In the method of manufacturing a gypsum board, as described, a hardened molding is cut by a cutting machine or the like to thereby form a cut body. However, when marks are preliminarily printed at predetermined intervals, a roughly cut body is cut in a process in which the cut body is conveyed along a conveyor or the like. In such a case, among manufactured cut bodies, one or more cut bodies in each of which a distance from a given end side of the cut body to a given first mark is shorter than a predetermined distance may exist. Consequently, the problem described above arises, resulting in a problem specific to the method in which the marks are preliminarily printed at a given upstream location (process prior to a rough cutting process) of the production line.

The present disclosure is addressed in view of the problem described above, and has an object to provide a building face material with printed indications and a method for manufacturing the building face material, where, even when any part of the building face material is cut in a cutting process in a manufacturing process, a first printed indication is marked at an allowable distance from an end side of the building face material that is rectangular in a plan view, and further, given printed indications are preliminarily marked, at predetermined intervals, along a straight line parallel to a long side of the building face material.

In order to solve the problem described above, one aspect of the present disclosure relates to a building face material with printed indications. The building face material includes at least one printed indication string including one string group that is repeated in cycles, the string group being formed, in a plan view, on a rectangular flat face of the building face material, and the strip group including multiple printed indications that are arranged, at regular first intervals, in a predetermined order along at least one straight line parallel to a first side or a second side of a rectangle. In the printed indication string, a distance from the first side or the second side perpendicular to the printed indication string, to a first printed indication, is shorter than the first interval.

Advantageous Effects of Invention

According to a building face material with printed indications according to one aspect of the present disclosure, the building face material with the printed indications can be provided, where, even when any part of the building face material is cut in a cutting process in a manufacturing process, a first printed indication is marked at an allowable distance from an end side of the building face material that is rectangular in a plan view, and given printed indications are preliminarily marked, at predetermined intervals, along a straight line parallel to a long side of the building face material. Also, when the building face material according to the present aspect is used, as described below, fastening of fixing portions can be performed accurately and efficiently, regardless of a skill level of a worker. Further, the overseeing of construction to check if fixing portions are driven at predetermined intervals can be performed extremely easily, because the fixing portions to be driven at the predetermined intervals are regularly driven at the predetermined intervals.

DESCRIPTION OF EMBODIMENTS

A building face material with printed indications according to one or more embodiments will be hereafter described with reference to the accompanying drawings. Note that in the specification and drawings, the same numbers denote any substantially identical components, and duplicate description for the components may be omitted.

[Building Face Material with Printed Indications According to the Embodiment]

Figure 1:
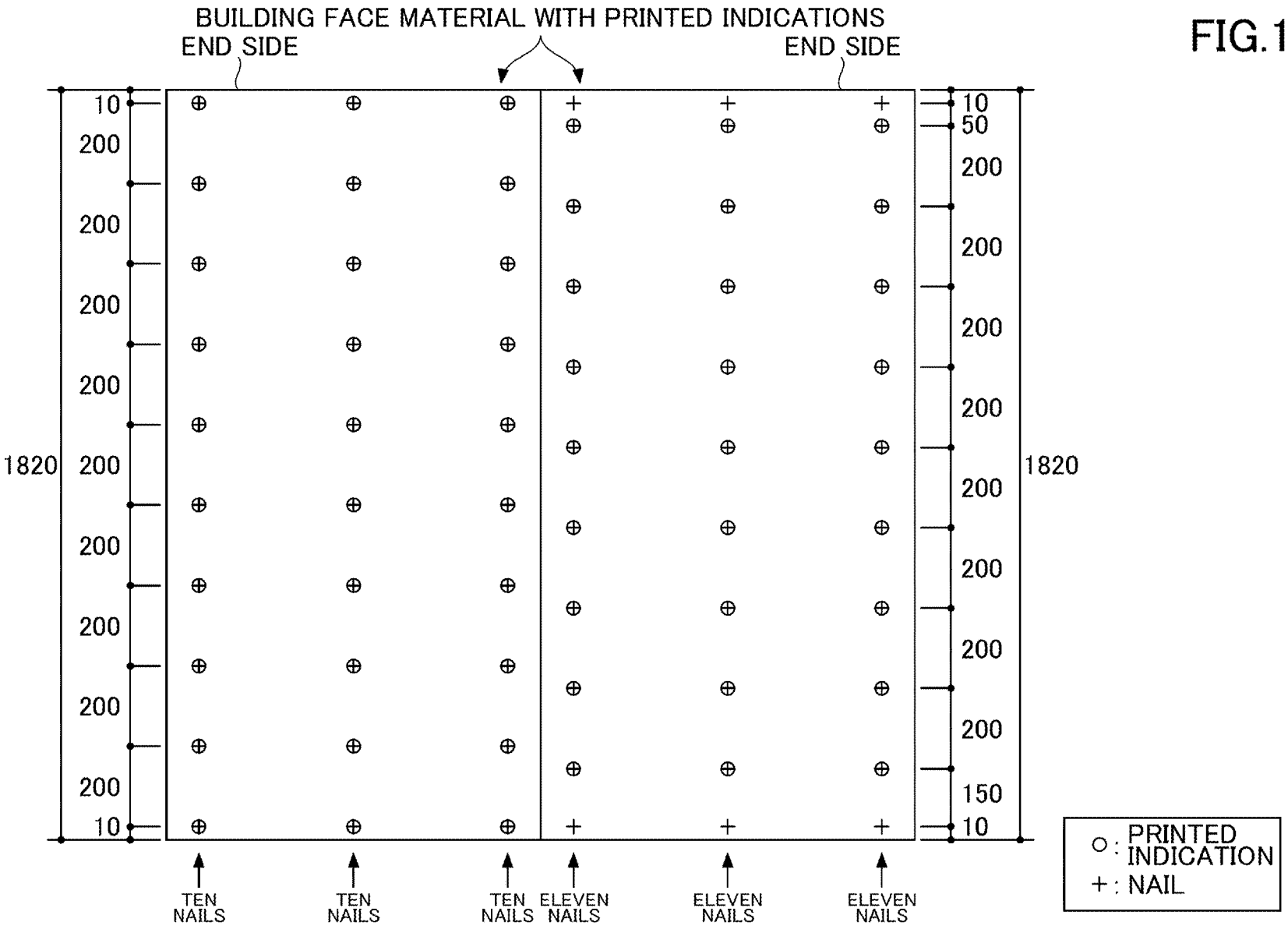
FIG. 1 is a front view of two building face materials that are arranged side by side, in a state of being driven with nails, where the building face materials are manufactured by a manufacturing method in which at an upstream location of a production line, marks of one type are printed on each building face material, at predetermined intervals, and each building face material is cut to a length of a product.
Figure 2:
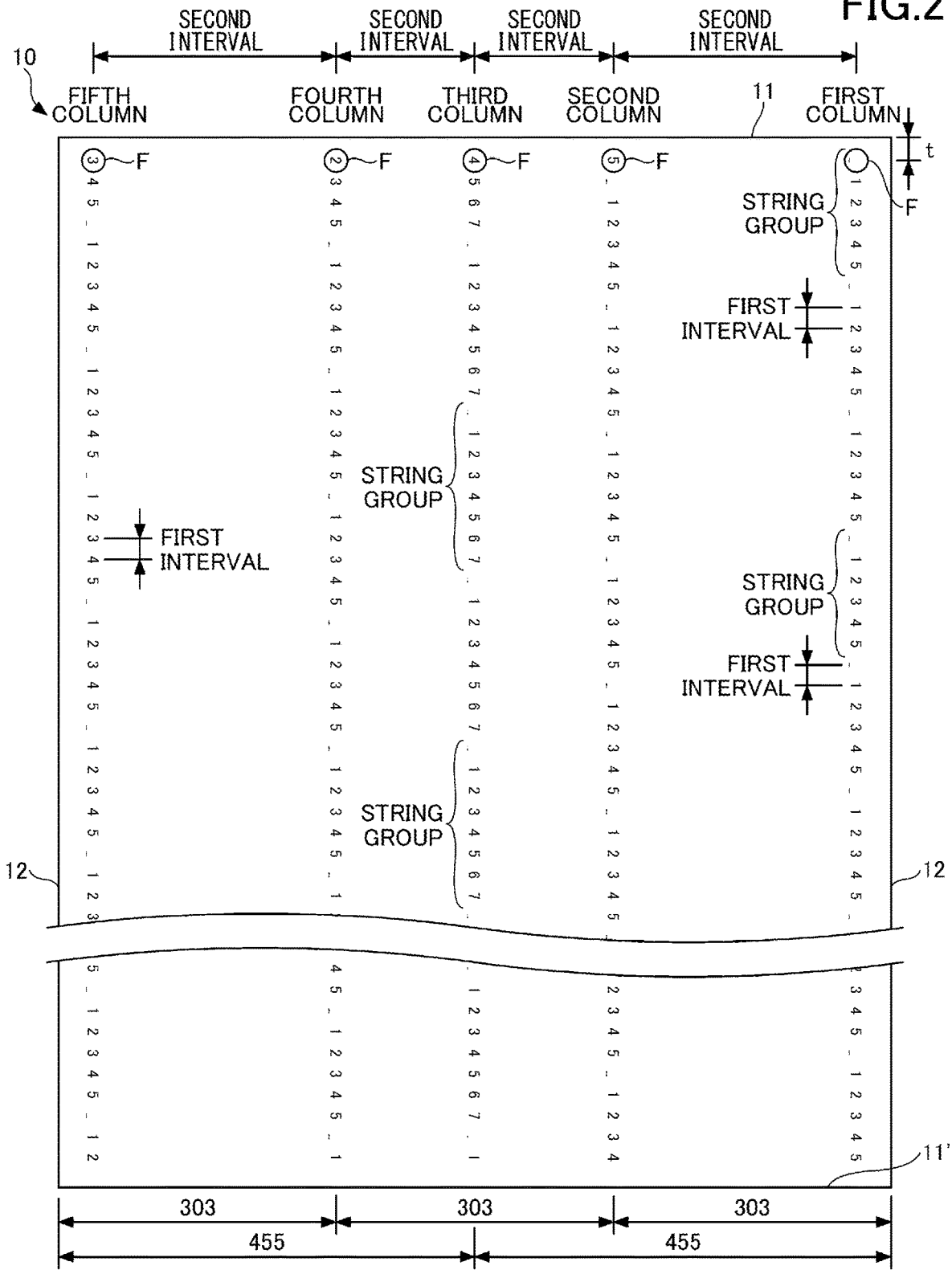
FIG. 2 is a plan view of an example of a building face material with printed indications according to an embodiment.
Figure 3:
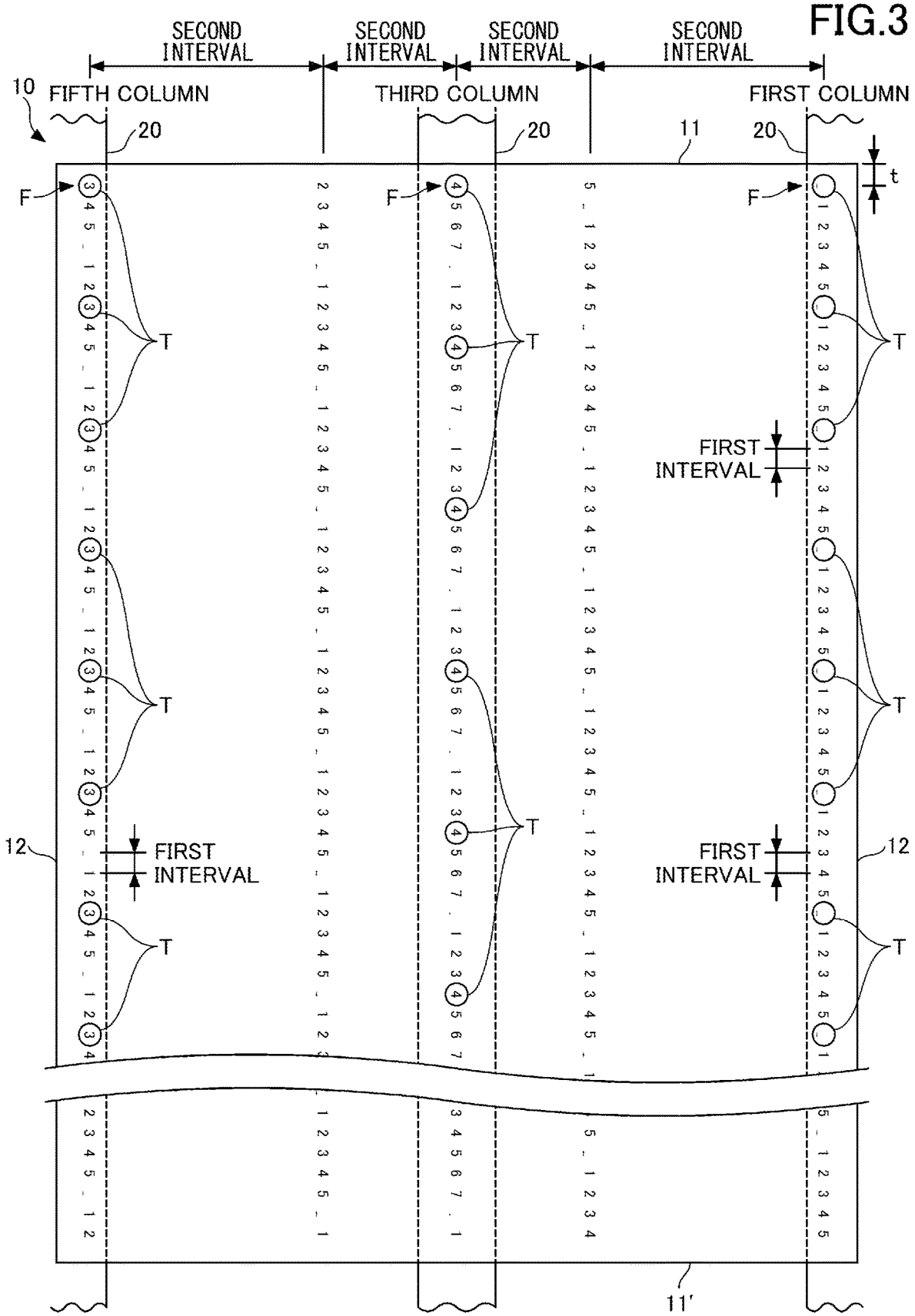
FIG. 3 is a diagram for describing a method of securing the building face material to backing materials according to the embodiment.

First, an example of the building face material with printed indications according to the embodiment will be described with reference to FIGS. 2 and 3. FIG. 2 is a plan view of an example of the building face material with printed indications according to the embodiment. FIG. 3 is a diagram illustrating a method of securing the building face material with printed indications according to the embodiment to backing materials. Note that in the following, the building face material with printed indications is described using a gypsum board. However, in addition to the gypsum board, the building face material with printed indications may include a calcium silicate board, a particle board, a hard board, plywood, plywood for a structure, or the like.

A building face material 10 with printed indications, as illustrated, is a gypsum board with a flat face that is rectangular (a rectangle) in a plan view. The building face material 10 has a pair of short sides 11 and 11' (which is an example of first sides) and a pair of long sides 12 (which is an example of second sides). For example, the building face material 10 is formed of a quasi-non-combustible material of which dimensions for a short side, a long side, and a thickness are 910 mm×1820 mm×9.5 mm, or, a non-combustible material of which dimensions are 910 mm×1820 mm (2420 mm or 2730 mm)×12.5 mm. Note that in this description, a case where the gypsum board has a width of 910 mm will be described. However, the width of the gypsum board is limited to being 910 mm, and may be 606 mm, 1000 mm, 1220 mm, or the like. The length and thickness of the gypsum board are also not particularly limiting. In addition to a typical gypsum board, the gypsum board includes, a reinforced gypsum board, a normally hardened gypsum board, a gypsum board with non-woven glass fiber, a glass-matted gypsum board, or the like.

As illustrated in FIG. 3, the building face material 10 with printed indications is fastened to backing materials 20 such as studs, with fixing portions such as screws, nails, or staples, such that the long sides 12 of the building face material 10 are fitted parallel to the backing materials 20. Note that the building face material 10 with printed indications may be fastened to the backing materials 20 such that the short sides 11 and 11' of the building face material 10 are fitted parallel to the backing materials 20. Alternatively, the flat face of the building face material 10 with printed indications may have a square planar shape.

In the building face material 10 with printed indications, as illustrated, on at least one face among the front face and the back face being flat faces of the building face material 10, one string group consisting of multiple printed indications that are arranged at first intervals in a predetermined order, along each of five straight lines that corresponds to a given column among a first column to a fifth column parallel to the long sides 12, is formed, and further, such a string group is printed in multiple cycles to thereby form one printed indication string. In this description, the "first interval" is a center-to-center distance between corresponding printed indications. A "second interval" described below corresponds to spacing between corresponding printed indication strings, or spacing between a given long side of the building face material and a given printed indication string. Such a "second interval" corresponds to a center-to-center distance between adjacent backing materials 20 by which the building face material 10 is fastened. Note that the string group includes a sequence of numbers, a sequence of alphabet letters, a sequence of hiragana, a sequence of katakana, a sequence of picograms, a sequence of symbols, a sequence of graphics, a sequence of kanji, alphabets representing a proper noun, hiragana representing a proper noun, katakana representing a proper noun, kanji representing a proper noun, or the like. Also, as illustrated in FIG. 3, a combination of the like of a sequence of numbers and a hyphen that is placed first before the sequence of numbers is also used. When color of each printed indication in a given string group is varied, the printed indication can be easily identified.

In this description, "at least one face among a front face and a back face" means a manner in which printed indications are marked only on the front face or the back face of two flat faces being the front and back faces where fastening of fixing portions is to be performed, as well as covering a manner in which printed indications are marked on both of the front face and the back face. For example, in a case of one face material, it is sufficient that printed indications are marked only on the front face or back face among flat faces of the face material where fastening of fixing portions is to be performed. In a case of a double face material, one face of an upper building face material 10, different from another face where fixing portions are driven, may be used as a glued face where gluing is performed where printed indications are each used a reference. Thus, the printed indications are preferably marked on both of the front face and the back face being the flat faces.

In an example in which the building face material 10 with printed indications has a width of 910 mm, in order to be available in both of use-case in which spacing between backing materials such as studs is 303 mm and a manner in which such spacing is 455 mm, printed indication strings each of which consists of multiple string groups in a given column among the first column to the fifth column are marked. In a case where spacing between backing materials is 303 mm, printed indication strings each of which consists of multiple string groups in a given column among the first column, the second column, the fourth column, and the fifth column are used when fastening of fixing portions is performed. Also, in a case where spacing between backing materials is 455 mm, printed indication strings each of which consists of multiple string groups in a given column among the first column, the third column, and the fifth column are used when fastening of fixing portions is performed. As described above, it is preferable in that the building face material 10 with printed indication strings each of which consists of a given string group that is repeated in cycles, can be applied to various spacing between given backing materials. However, in order to apply to given spacing between backing materials, a given building face material with only a printed indication string that consists of a given string group that is repeated in cycles, may be adopted. For example, a building face material with a printed indication string, in only one column, which consists of a given string group that is repeated in cycles, may be adopted.

In the illustrated example, in each of the first column, the second column, the fourth column, and the fifth column, one string group consists of six printed indications in total, and the six printed indications are an underscore ("_") and numbers from 1 to 5 that are arranged in this order, such that a center-to-center distance (which is an example of a first interval) between corresponding printed indications is 25 mm. Further, such a string group is printed in cycles, along one straight line parallel to the long sides 12, to thereby form a given printed indication string. In this description, the length of one string group is given as follows. 25 mm×6=150 mm.

Further, in the third column, one string group consists of eight printed indications in total, and the eight printed indications are an underscore ("_") and numbers from 1 to 7 that are arranged in this order, such that a center-to-center distance between corresponding printed indications is 25 mm. Further, such a string group is printed in cycles, along one straight line parallel to the long sides 12, to thereby form a given printed indication string. In this description, the length of one string group is given as follows. 25 mm×8=200 mm.

The first interval that is the center-to-center distance between corresponding printed indications is set in the range of 5 mm to 50 mm, and preferably in the range of 10 mm to 30 mm. For example, the first interval can be set to a value corresponding to a case where the standards of spacing between fixing portions that are driven specify 100 mm or less, 150 mm or less, 200 mm or less, or 300 mm or less, or the like. A value indicating less than 45 mm is selected in consideration to the relation with the length of a given string group described below. Also, the length of one string group is set in the range of 45 mm to 333 mm, depending on the length of a given face material. A value indicating 45 mm is a value conforming to the above standards of spacing between fixing portions that are driven, and is a minimum value of the spacing between fixing portions that are driven. Note that a value indicating 333 mm is assumed to meet a standardized designing dimension. For each of the spacing or length described above, according to the standards of spacing between fixing portions that are driven, the definition of "less than or equal to" predetermined spacing is applied. For this reason, in order to prevent from exceeding the predetermined spacing due to aiming failure or the like, there are cases of setting a target to be less than or equal to predetermined spacing. Additionally, spacing (which is an example of a second interval) between corresponding columns is set in the range from 100 mm to 1220 mm.

When fixing portions are driven in each column, in a case where each printed indication F that is placed first from one short side 11 (end side) of the building face material 10 is given as a first driving position of a given fixing portion, a distance t between the short side 11 and the first printed indication F is limited to the range of 5 mm to 50 mm for the first interval. In other words, even when a molding or the like is cut at any location of the cutting process in the production line, the distance t between the short side 11 and the first printed indication F is set in the range of the first interval. For this reason, relative variations in positions of the building face materials that are fastened are also set in the range of the first interval. Note that distances t in respective columns may differ slightly from each other because printed indications in each of the columns are marked by a separate ink jet printer or the like. However, relative variations in the driving positions for all columns remain within the range of the first interval.

For example, in the first column, the printed indication F that is placed first from a given short side 11 is an underscore ("_"). In such a manner, in the first column, as illustrated in FIG. 3, the underscore ("_") as the first printed indication F is set at a first driving position of a given fixing portion, and underscores ("_") that are characters T commonly used in subsequent string groups are respectively set at driving positions of given fixing portions. Thus, the fixing portions can be each inevitably drived at 150 mm (at a 150 mm interval) away from another fixing portion, where the length of each string group is 150 mm. In other words, in the first column, each underscore ("_") that is the first printed indication F and that is the common character T in the string groups becomes the driving position of a given fixing portion.

Note that, in the second column, a printed indication F that is placed first from a given short side 11 is "4," and all of the characters "4," as common characters T, are marked as driving positions of given fixing portions. Thus, the fixing portions can be inevitably drived at 200 mm intervals. In the fifth column, a printed indication F that is placed first from a given short side 11 is "3," and all of the characters "3," as common characters T, are set as driving positions of given fixing portions. Thus, the fixing portions can be inevitably driven at 150 mm intervals.

Note that a blank on which a printed indication is not marked may be placed instead of the underscore ("_"). When the underscore ("_") illustrated in the above example, or the blank " " on which a printed indication is not marked, is placed first or last in each of string groups, the string groups in which a given string group is aligned in cycles can be distinctively viewed easily, in comparison to string groups in which only numbers are arranged as printed indications. Thus, given printed indications commonly used in the string groups can be easily detected. Note that for example, in the first column or the like for the building face material 10 with printed indications, "0" is placed instead of the underscore ("_"), string groups consisting of only numbers may be used.

In this description, as a given first printed indication F, a printed indication that is placed first from a given short side 11 is not necessarily adopted. When the first interval is small, for example, a given printed indication that is placed second from the short side 11 is set as the first printed indication F, and in each subsequent string group, a given character T commonly used as the first printed indication F may be set at each driving position.

For example, for one wall face material with quasi-fire resistance (framework), as specified by the ministerial ordinance, spacing between fixing portions to be driven to each of a peripheral portion and an intermediate portion of the face material is specified to be 150 mm or less. In such a case, when such a wall is constructed such that spacing between backing materials is 303 mm, a building face material (not illustrated) with printed indications, in which the length of a given string group in each of the first column, the third column, and the fifth column is 150 mm, is adopted, instead of the building face material in FIGS. 2 and 3. Likewise, for one ceiling face material with quasi-fire resistance (framework), as specified by the ministerial ordinance, spacing between fixing portions to be driven to each of a peripheral portion and an intermediate portion of the face material is specified to be 150 mm or less, or 200 mm or less. In such a case, the building face material 10 with printed indications, as illustrated in FIGS. 2 and 3, can be adopted.

As described above, according to the building face material 10 with printed indications, as illustrated, even when any part of the building face material 10 is cut in the cutting process in the manufacturing process, the building face material 10 with printed indications can be provided, in which each first printed indication F is marked at an allowable distance from a given end side (short side 11) of a rectangle in a plan view, and given printed indications subsequent to the first printed indication F are preliminarily marked at predetermined intervals, in a given column.

Also, for example, a worker respectively adjusts first printed indications F and the same printed indications as the first printed indications F of a given building face material 10 with printed indications, to positions of the building face material 10 to be fastened to one or more backing materials 20 by given fixing portions. In such a manner, relative variations in the fastened positions of corresponding building face materials are set in the range of the first interval. Thus, fastening of the fixing portions can be performed accurately and effectively, regardless of a skilled level of the worker. In this case, the fixing portions to be driven at predetermined intervals can be regularly driven at the predetermined intervals. Accordingly, the overseeing of construction to check if the fixing portions are driven at predetermined intervals is performed extremely easily. Additionally, in a case where a given building face material is fastened to given backing materials parallel to the short side of a given building face material, the building face material can be used.

<Building Face Material with Printed Indications According to First Modification>

Figure 4:
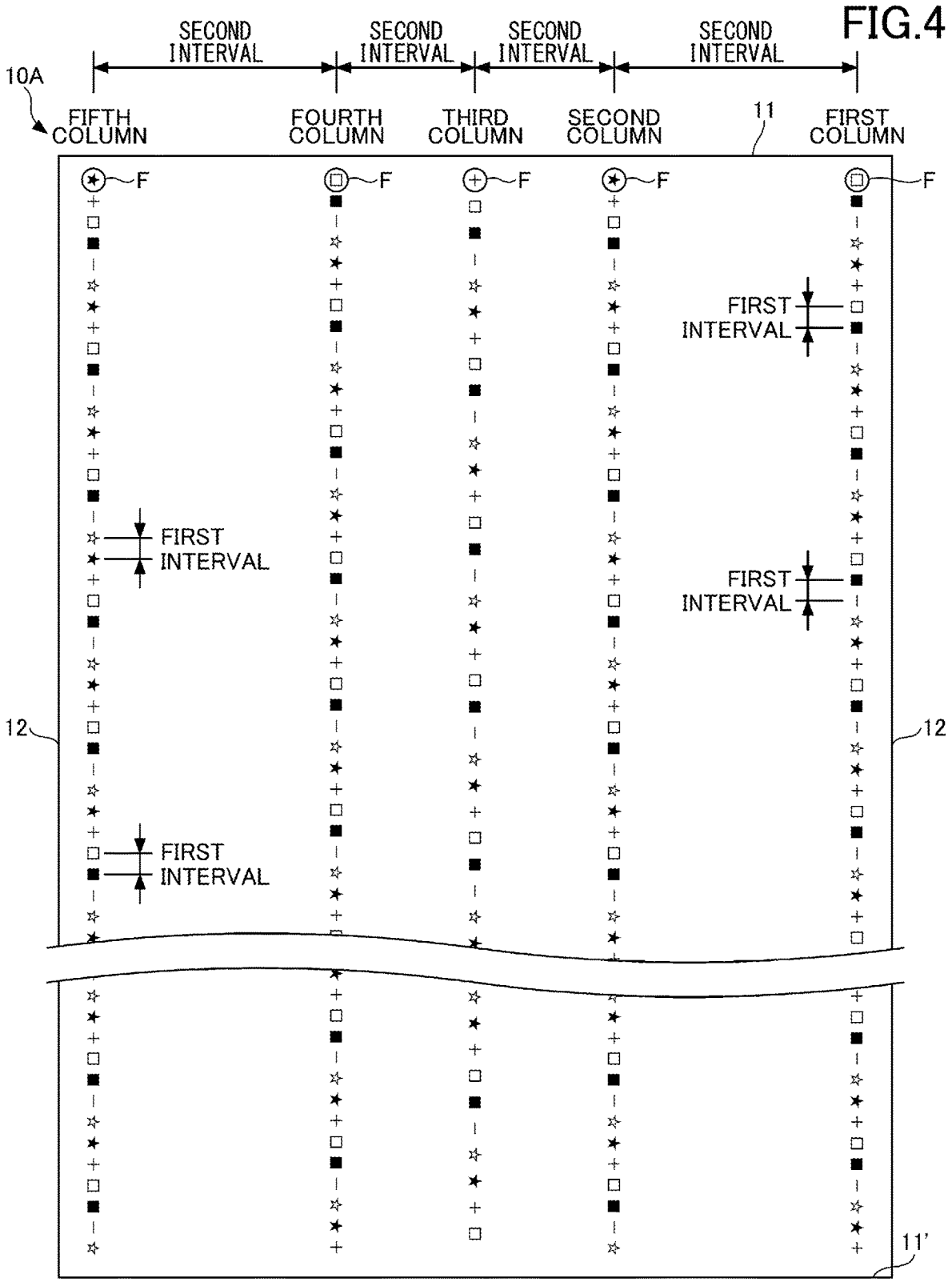
FIG. 4 is a plan view of an example of the building face material with printed material according to the first modification.

Hereafter, the building face material with printed indications according to the first modification will be described with reference to FIG. 4. FIG. 4 is a plan view of an example of the building face material with printed indications according to the first modification.

For a building face material 10A with printed indications, as illustrated, one string group consists of six pictograms such as "□" and "☆," which are arranged in a predetermined order, and such a string group is repeated in multiple cycles. Further, in the building face material 10A with printed indications, for example, in each of the first column, the second column, and the like in which fixing portions are driven at 150 mm intervals, first interval between corresponding pictograms is 25 mm. Further, in the third column in which fixing portions is driven at 200 mm intervals, first interval between corresponding pictograms is 33 mm. As described above, according to the building face material 10A, when the intervals for fastening differ, the number of printed indications that are included in a given string is the same, and spacing (first interval) between corresponding printed indications differs. In such a manner, the building face material 10A can be used.

<Building Face Material with Printed Indications According to Second Modification>

Figure 5:
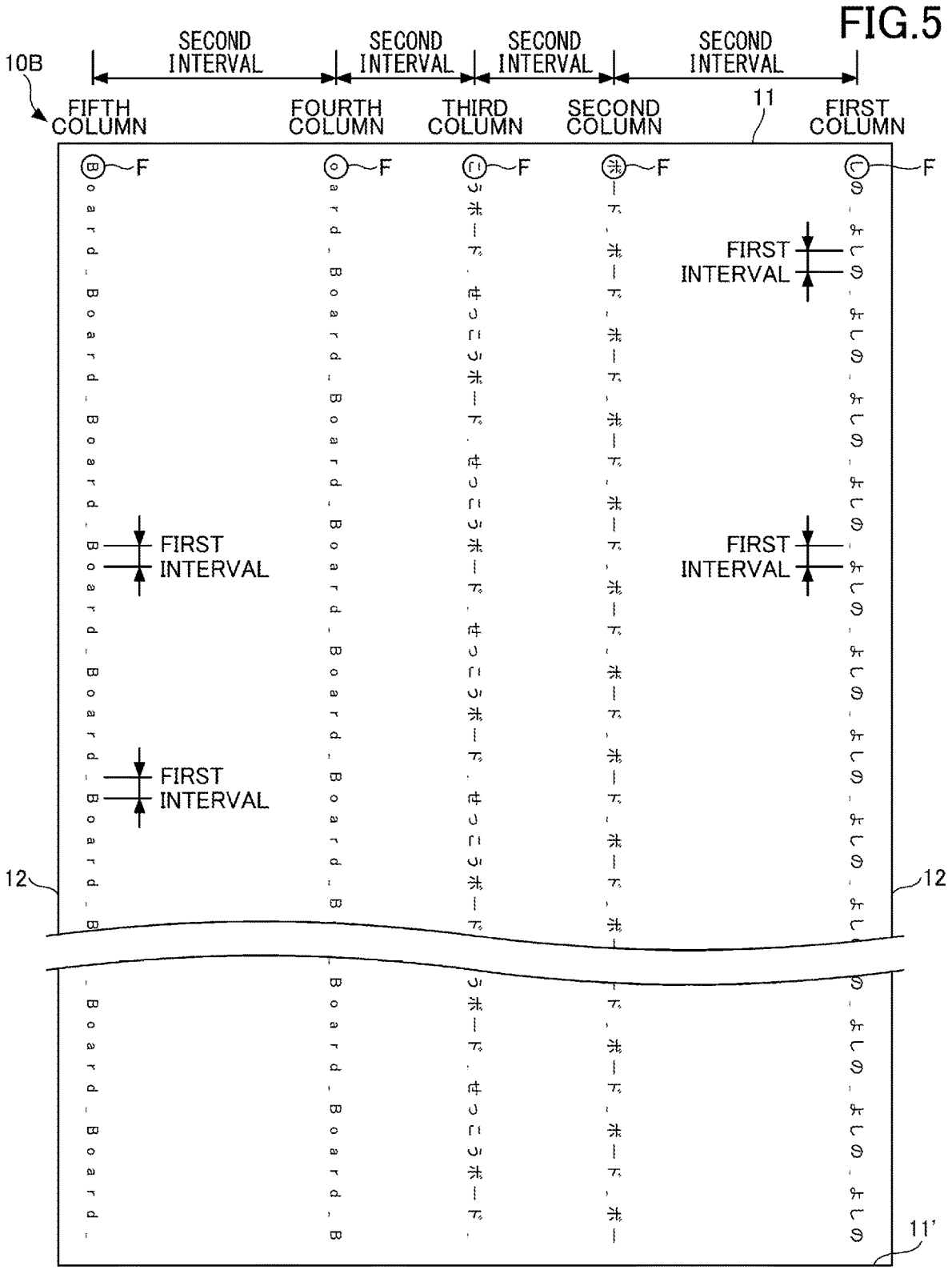
FIG. 5 is a plan view of an example of the building face material with printed material according to the second modification.

Hereafter, the building face material with printed indications according to the second modification will be described with reference to FIG. 5. FIG. 5 is a plan view of an example of the building face material with printed indications according to the second modification.

For a building face material 10B with printed indication, as illustrated, a combination of multiple types of printed indications is shown. In the first column, each string represents "_よしの," in the second column, each string represents "_Board," and in a third column, each string represents "_せっこうボード." In each of the fourth column and the fifth column, each string represents "_Board." In an example, in all columns, a proper noun represented by hiragana, such as "_よしの," may be uniformly used, or alternatively, a proper noun such as "せっこうボード," represented by hiragana and katakana, may be uniformly used. Further, in all columns, a proper noun such as "_Board" represented by alphabets can be uniformly used. Although not illustrated, a string may consist of letters or the like in alphabetical order, such as A, B, and C.

[Example of Method of Manufacturing Building Face Material with Printed Indications]

Figure 6:
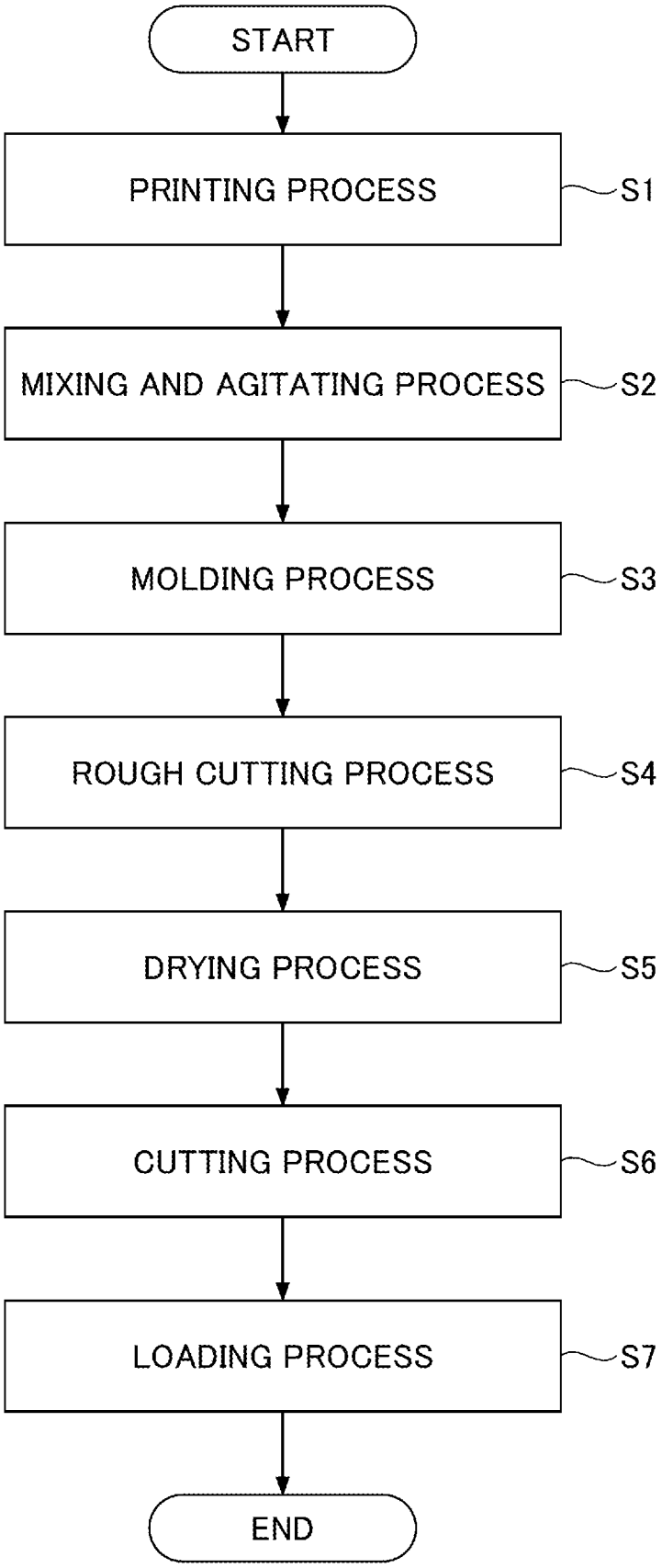
FIG. 6 is a flowchart illustrating a method of manufacturing the building face material with printed indications according to the embodiment.

Hereafter, an example of the method of manufacturing the building face material with printed indications will be described with reference to FIG. 6. FIG. 6 is a flowchart illustrating the method of manufacturing the building face material with printed indications according to the embodiment. Note that such a manufacturing method is performed using a continuous type molding machine (not illustrated).

First, in first step S1 of the manufacturing method, a printing process is performed. For example, in a midway location of a conveyance path along which the back paper (board base paper) and front paper (board base paper) are continuously conveyed at the same speed, one or more ink jet printers are each provided corresponding to a given column among five columns in which string groups are printed. When printed indications are marked on only the back paper, which corresponds to the front face of a given building face material, an ink jet printer is provided only below the conveyance path. When printed indications are marked on both sides being the front and back faces of the building face material, ink jet printers are provided above and below the conveyance path. When each ink jet printer is controlled to be turned on based on a conveyance speed of a given paper among the back paper and front paper that is continuously conveyed, as well as on a predetermined time interval. In general, the back paper side of a typical gypsum board is used as the front face thereof, and the front paper side of the gypsum board is used as the back face thereof.

In the process of continuously conveying the back paper and the like, one or more ink jet printers each print a given string group consisting of printed indications, in multiple cycles, as illustrated in FIG. 2 and the like.

Further, in a mixing and agitating process that is in second step S2, calcined gypsum, water, an adhesive as necessary, and other various additives are agitated and mixed by a mixer (main mixer) to thereby produce homogeneous gypsum slurry. In this description, as calcined gypsum, β-type calcined gypsum type, α-type calcined gypsum, or a mixture thereof can be used, and the β-type calcined gypsum or α-type calcined gypsum is obtained by sintering, in the atmosphere or in water (including vapor), gypsum such as natural gypsum, byproduct gypsum, or gypsum obtained using a flue-gas desulfurization process, or, a mixture of these types of gypsum. Examples of an adhesive include starch, poval, carboxymethylcellulose (CMC), and the like. Further, examples of the various additives include various water reducing agents, hardening modifiers, waterproofing agents, reinforcing fibers, light weight aggregates, and the like.

After the printed indications are marked on the back paper or the like, in a molding process that is third step S3, gypsum slurry is deposited on the front of the back paper (board base paper) that is continuously conveyed. Then, the back paper is folded along curved lines that are formed proximal to side edges of the back paper so as to wrap the gypsum slurry, while a given front paper (board base paper) that is conveyed at the same speed as the back paper is laminated on a layer of the gypsum slurry. Then, the layer of the back paper, the gypsum slurry, and the front paper is conveyed to a molding machine that determines a thickness and width of a given gypsum board to thereby perform molding. By such molding, a molding is formed. The molding is hardened by a hydration reaction of calcined gypsum in gypsum slurry, in a process of conveying the molding through a belt conveyor or the like.

Then, in a rough cutting process that is fourth step S4, the formed molding is conveyed to a rough cutting machine (rotary cutter) through the belt conveyor or a conveyance roller, and the molding is roughly cut by the rough cutting machine. For example, a roughly cut body having a long side length of 6000 mm, being three times or more greater than a long side length of 1820 mm for each one building face material, can be formed.

Subsequently, in a drying process that is fifth step S5, the roughly cut body is conveyed to a dry machine (dryer) and then is forcibly dried. Note that between the rough cutting machine (rotary cutter) and the dryer in the rough cutting process, there may be a process in which, for example, an inverting device (inverter) inverts a given board face with respect to the front and back, in accordance with the layout or the like of a given device, or alternatively, a conveying process may be performed along a conveyance roller or a conveyance belt.

In a cutting process that is sixth step S6, the dried roughly cut body is conveyed to a cutting machine (sizer) along a conveyance belt or the like, and then is cut into product sized pieces by the cutting machine (sizer). In the above example, the roughly cut face is rough and is not perpendicular to the flat face of the building face material. For this reason, both ends of the roughly cut body are slightly cut and thus three products each having a long side length of 1820 mm, from which pieces cut at both ends of the roughly cut body are removed, are manufactured.

For example, each product manufactured in the cutting process is the building face material 10 with printed indications, as illustrated in FIG. 2. In such a manner, the building face material 10 on which the printed indications are marked can be manufactured in the production line.

In a loading process that is seventh step S7, manufactured building face materials 10 with printed indications, in a predetermined number, are regularly piled up by a lifter or the like, and then are stored in a warehouse.

As described above, the continuous type molding machine is used to mark printed indications, at the upstream location from a given area where the molding process is performed, and the building face material 10 with the printed indications can be manufactured in the production line.

Thus, significant time and labor to be required in a manufacturing method of removing given building face materials one by one from piled building face materials, printing marks on a removed building face material along a given straight line parallel to the long side of the building face material, returning the building face material on which the marks are printed to the piled building face materials, and subsequently, removing another face material from the piled face materials to print marks in the same manner, can be eliminated. Accordingly, the building face material 10 with printed indications can be manufactured with high manufacturing efficiency.

Note that the printing process may be performed not only before the mixing and agitating process illustrated in FIG. 6 but also between the molding process and the rough cutting process, for example. Even in such a case, the printing process is still to be performed at the upstream location of the production line.

For the configurations or the like described in the above embodiments, other embodiments, such as combinations with other components, may be adopted. The present disclosure is not limited to the configurations illustrated in this description. In this regard, changes can be made to the extent that the spirit of the present disclosure does not depart, and can be appropriately determined in accordance with its application manners.

This international application claims priority under Japanese Patent Application No. 2018-239480, filed Dec. 21, 2018, the entirety of which is incorporated herein by reference.

REFERENCE SIGNS LIST

10, 10A, 10B building face material with printed indications (building face material); 11 short side (first side or end side); 12 long side (second side); 20 backing material (stud); F first printed indication; T common printed indication

The invention claimed is:

1. A building face material with printed indications, comprising:

individual symbol groups arranged along each straight line of a plurality of straight lines, each of the individual symbol groups including symbols that are different from one another, and different symbols in the individual symbol groups being continuously arranged at regular first intervals along the straight line parallel to a first side or a second side of a rectangle of the building face material, wherein in a first symbol group among the individual symbol groups arranged along each straight line of the plurality of straight lines, a distance from the first side or the second side perpendicular to the straight line along which the different symbols are arranged, to a first symbol of the different symbols, is shorter than the first interval, wherein the different symbols in each of the individual symbol groups are arranged in the same order, wherein each of the individual symbol groups in each straight line of the plurality of straight lines includes a same symbol as the first symbol in the first symbol group, wherein each of the same symbol and the first symbol indicates a position where the building face material is to be fastened, and wherein the first symbol of a first line of the plurality of straight lines differs from the first symbol of a second line of the plurality of straight lines.

2. The building face material with printed indications according to claim 1, wherein each of the same symbol and the first symbol indicates the position where a fixing portion is to be driven.

3. The building face material with printed indications according to claim 1, wherein each of the regular first intervals is in a range of 5 mm to 50 mm, and wherein each of the individual symbol groups has a length in a range of 45 mm to 333 mm.

4. The building face material with printed indications according to claim 1, wherein individual symbol groups are arranged at second intervals, and wherein each of the second intervals is in a range of 100 mm to 1220 mm.

5. The building face material with printed indications according to claim 4, wherein each of the second intervals is a same as a center-to-center distance between adjacent backing materials by which the building face material is to be driven.

6. The building face material with printed indications according to claim 1, wherein each of the individual symbol groups includes (i) one type string or (ii) a combination of the one type string and either of another symbol or a blank, the another symbol or the blank being placed first or last in the individual symbol group, and wherein the one type string is selected from among a sequence of numbers, a sequence of alphabet letters, a sequence of hiragana, a sequence of katakana, a sequence of picograms, a sequence of symbols, a sequence of graphics, a sequence of kanji, alphabet letters representing a proper noun, hiragana representing a proper noun, katakana representing a proper noun, and kanji representing a proper noun.

7. A method for manufacturing a building face material with printed indications, the method comprising:

forming individual symbol groups that are arranged along each straight line of a plurality of straight lines, each of the individual symbol groups including symbols that are different from one another, and different symbols in the individual symbol groups being continuously at regular first intervals along the straight line parallel to a first side or a second side of a flat face of the building face material that is rectangular in a plan view, and printing the individual symbol groups on a board base paper included in the building face material, or a molding of the building face material, wherein the different symbols in each of the individual symbol groups are arranged in the same order, wherein each of the individual symbol groups in each straight line of the plurality of straight lines includes a same symbol as a first symbol of the different symbols in a first symbol group among the individual symbol groups, wherein each of the same symbol and the first symbol indicates a position where the building face material is to be fastened, and wherein the first symbol of a first line of the plurality of straight lines differs from the first symbol of a second line of the plurality of straight lines.

8. The method for manufacturing a building face material with printed indications according to claim 7, wherein in the printing, the individual symbol groups are printed, by a given ink jet printer associated with the straight line along which the individual symbol groups are arranged, the given ink jet printer being among ink jet printers and being mounted at an upstream location of a production line for the building face material.

9. The method for manufacturing a building face material with printed indications according to claim 7, further comprising:

depositing, after the printing, gypsum slurry on the board base paper on which the printed individual symbol groups are marked, to form the molding;

roughly cutting the molding to form a rough cutting body; and cutting the rough cutting body to a product size to manufacture the building face material with printed indications.

* * * * *